US005323466A

United States Patent [19]

Geddes

[11] Patent Number: 5,323,466

[45] Date of Patent: Jun. 21, 1994

[54] TANDEM TRANSDUCER MAGNET STRUCTURE

[75] Inventor: Earl R. Geddes, Livonia, Mich.

[73] Assignee: Ford Motor Company, Dearborn, Mich.

[21] Appl. No.: 868,151

[22] Filed: Apr. 14, 1992

Related U.S. Application Data

[63] Continuation-in-part of Ser. No. 514,625, Apr. 25, 1990, Pat. No. 5,119,902, and a continuation-in-part of Ser. No. 862,884, Apr. 3, 1992.

[51] Int. Cl.[5] ..... G10K 11/16

[52] U.S. Cl. ..... 381/71; 381/89; 381/199

[58] Field of Search ..... 381/71, 199, 89, 195, 381/202

[56] References Cited

U.S. PATENT DOCUMENTS

| | | | |
|---|---|---|---|
| 1,969,704 | 8/1934 | D'Alton | 181/156 |
| 2,903,673 | 9/1959 | Harris | 381/182 |
| 3,393,764 | 7/1968 | Schafer | 181/31 |
| 4,153,815 | 5/1979 | Chaplin et al. | 381/71 |
| 4,472,605 | 9/1984 | Klein | 381/195 |
| 4,473,906 | 9/1984 | Warnaka et al. | 181/206 |
| 4,480,333 | 10/1984 | Ross | 381/71 |
| 4,520,237 | 5/1985 | Murakami | 381/199 |
| 4,549,631 | 10/1985 | Bose | 181/156 |
| 4,665,549 | 5/1987 | Eriksson et al. | 381/71 |
| 4,665,550 | 5/1987 | Haas | 381/199 |
| 4,669,122 | 5/1987 | Swinbanks | 381/71 |
| 4,677,676 | 6/1987 | Eriksson | 381/71 |
| 4,677,677 | 6/1987 | Eriksson | 381/71 |
| 4,720,868 | 1/1988 | Hirano | 381/182 |
| 4,736,431 | 4/1988 | Allie et al. | 381/71 |
| 4,783,817 | 11/1988 | Hamada et al. | 381/71 |
| 4,783,820 | 11/1988 | Lyngdorf et al. | 381/89 |
| 4,805,733 | 2/1989 | Kato et al. | 181/206 |
| 4,815,139 | 3/1989 | Eriksson et al. | 381/71 |
| 4,837,834 | 6/1989 | Allie | 381/71 |
| 4,876,722 | 10/1989 | Dekker et al. | 381/71 |
| 4,878,188 | 10/1989 | Ziegler, Jr. | 364/724 |
| 4,989,254 | 1/1991 | Amalaha | 381/202 |
| 5,146,505 | 9/1992 | Pfaff et al. | 381/86 |
| 5,229,556 | 7/1993 | Geddes | 381/71 |
| 5,233,137 | 8/1993 | Geddes | 381/71 |
| 5,257,316 | 10/1993 | Takeyama et al. | 381/71 |
| 5,272,286 | 12/1993 | Cain et al. | 381/71 |

FOREIGN PATENT DOCUMENTS

| | | |
|---|---|---|
| 4019645 | 1/1991 | Fed. Rep. of Germany . |
| 768373 | 8/1934 | France . |
| 2191063 | 12/1987 | United Kingdom . |

*Primary Examiner*—Forester W. Isen

*Attorney, Agent, or Firm*—Roger L. May; Mark L. Mollon

[57] ABSTRACT

An active muffler for use in motor vehicles comprises a sensor, an electronic control responsive to the signal generated by the sensor for producing a drive signal delivered to a transducer which emits cancellation pulses phased 180° from the sound pressure pulses passing through a conduit, where both front and rear sides of the transducer are acoustically coupled to the conduit to improve the efficiency of the transducer operation. Preferably, the acoustic coupling comprises an enclosed chamber including a port for communicating with the conduit which can be tuned to resonate at predetermined frequencies. When both sides of the transducer are so coupled to the conduit, the transducer has increased efficiency over a broad band of frequencies, and the frequency band can be broadened at the low end as required to accommodate the frequencies generated by a source of noise. A tandem transducer mounting arrangement according to the present invention reduces vibration of the housing while minimizing the mass and size of the transducers by juxtaposing or consolidating the magnet structure for a pair of transducer diaphragms. The system is particularly suitable for use in adapting noise cancellation techniques to replace or be combined with passive mufflers on motor vehicles.

6 Claims, 2 Drawing Sheets

TANDEM TRANSDUCER MAGNET STRUCTURE

CROSS REFERENCE TO RELATED APPLICATIONS

The present application is a continuation-in-part of copending U.S. patent application Ser. No. 514,624, filed Apr. 25, 1990, entitled "Active Muffler Transducer Arrangement" now U.S. Pat. No. 5,119,902 and my U.S. patent application Ser. No. 862,884 filed Apr. 13, 1992 entitled "Dual Bandpass Secondary Source".

TECHNICAL FIELD

The present invention relates generally to noise reduction apparatus, and more particularly to transducer constructions for active sound cancellation devices made applicable for use with motor vehicles.

BACKGROUND ART

Internal combustion engines typically used in motor vehicles generate a substantial amount of noise due to the combustion occurring within the engine. Conventionally, the noise generated is suppressed by a passive muffler system in which the sound waves are broken up by resonance with baffles, passageways and the like or absorbed by fibrous material. However, such techniques of reducing the sound level also obstruct the free flow of exhaust gases through the exhaust conduits and therefore substantially interfere with efficient operation of the vehicle engine by interfering with the release of combustion products and inhibiting the replacement of the combusted gases with fresh fuel in the engine cylinders. Nevertheless, despite the reduction in economy and performance, the need for substantially reduced noise levels requires the use of mufflers on all production motor vehicles.

Although active noise cancellation systems have been employed with large ducts used for heating and ventilation in large buildings, the previously known systems are not well adapted for use in the environment of motor vehicles. For example, U.S. Pat. No. 4,473,906 to Warnaka et al discloses numerous prior art sound attenuation system embodiments. In general, sensed sound pressure produces a signal adapted to drive a loudspeaker for inputting cancellation signals into the duct. The cancellation signal is an acoustic pulse signal 180° out of phase with the signal passing past the speaker through the duct. The prior art embodiments also illustrate improved noise attenuation performance by reducing the effect of the feedback of the cancellation signal which arrives at the sensor. The patent discusses the inclusion of additional transducers and electronic controls to improve the performance of the active acoustic attenuator.

U.S. Pat. No. 4,677,677 to Eriksson further improves attenuation by including an adaptive filter with on-line modeling of the error path and the canceling speaker by using a recurslye algorithm without dedicated off-line pretraining. U.S. Pat. No. 4,677,676 adds a low amplitude, uncorrelated random noise source to a system to improve performance. Likewise, U.S. Pat. Nos. 4,876,722 to Decker et al and 4,783,817 to Hamada et al disclose particular component locations which are performance related and do not adapt active attenuator noise control systems to motor vehicles.

However, none of these improvements render the system applicable to muffle engine noise in the environment of a motor vehicle. For example, such systems often employ extremely large transducers such as 12 or 15 inch loudspeakers of conventional construction. Such components are not well adapted for packaging within the confines of the motor vehicle, and particularly, within the undercarriage of the motor vehicle. Moreover, since the lowest frequency of the signal to be cancelled is on the order of 25 hertz, a large loudspeaker is used to generate sound signals with sufficient amplitude in that range, and such speakers are not practical to mount beneath a motor vehicle. Moreover, although the highest frequencies encountered are easier to dissipate because of their smaller wavelength, the highest frequency to be cancelled is on the order of 250 hertz.

Moreover, many of the above-mentioned systems locate the speakers within the ducts subjected to the sound pressure signal. The loudspeakers conversationally employed in those systems would not fit within conventional exhaust conduits for motor vehicles. Furthermore, the harsh environmental conditions within such a chamber would adversely affect the described known systems and diminish their performance in a motor vehicle.

Although there have been known techniques for increasing the efficiency of audio loudspeakers, those teachings have not been considered readily applicable to active noise attenuating systems. French Patent No. 768,373 to D'Alton, U.S. Pat. No. 4,549,631 to Bose and the Bandpass Loudspeaker Enclosures publication of Geddes and Fawcett presented at the 1986 convention of the Audio Engineering Society acknowledge the phenomena of tuning loudspeaker output by the use of chambers including ports. The recognition of this phenomena has been limited to its effect upon audio reproduction, and particularly dispersion of the audio signal to an open area outside the loudspeaker enclosure. The closed conduit system of motor vehicle exhaust systems, and the harsh conditions associated with such systems, is a substantially different environment.

In addition, my above-identified copending applications discuss improvements and the advantages to be obtained by ported communication of multiple transducer faces with an exhaust conduit. However, the mounting of multiple transducers increases the packaging problems, material costs and assembly complexity of the vehicle. Furthermore, a back to back alignment of transducers may position the magnets so that the magnetic fields can interfere with efficient operation of the transducers.

SUMMARY OF THE INVENTION

The present invention substantially reduces the difficulty of employing active attenuation technology to motor vehicle exhaust systems by using the front and rear emissions from a pair of transducers to effect cancellation of sound pressure pulses in a conduit enclosure. In general, at least one side of each speaker transducer is enclosed within a chamber including a port acoustically coupled to the conduit for canceling sound pressure pulses in the conduit. Preferably, both sides of each transducer diaphragm are enclosed within separate chambers, each of which has a port. However, each transducer shares a common magnet to reduce size and mass of the system while improving the efficiency of the cancellation pulse generator and reducing input power required to drive the transducers. Preferably, the ported chambers are tuned for high and low ends, respectively, of a frequency band containing the sound pressure pulses to be cancelled.

In the preferred embodiment, a pair of transducer diaphragms mounted in a housing enclosure compensate for the reaction of the transducer mounting to the movements of the transducer. The facing or rear transducer diaphragm sides are driven in a common chamber that is preferably ported to the conduit. The opposite or front sides of the diaphragms are also ported to the exhaust conduit. Preferably, the diaphragms are positioned to enclose chambers defined by the housing and coupled by the ports to the exhaust conduit. With both transducer diaphragms driven in-phase by reversed polarity terminals or oppositely wound coils positioned in gaps at both ends of a single magnet, the diaphragms are displaced in opposite directions. Vibration of the housing is reduced by the induced cancellation effect of opposite but equal pressure pulses. The common chamber and the port for communication with the exhaust conduit are preferably tuned for resonance at or near a high frequency component of the cancellation signal while the front side chambers and ports are preferably tuned at or near a low frequency component of the signal bandwidth.

Thus, the present invention provides an active noise cancellation system particularly well adapted for use in motor vehicles since the increased efficiency of the transducer arrangement reduces the packaging requirements for the noise cancellation system. Moreover, the arrangement permits easier and protected mounting of a transducer despite the environment and high temperature conditions involved with exhaust system components. Furthermore, the housing chambers and ports can be tuned to assure the band-width is particularly well adapted for use in the noise frequency range associated with conventional motor vehicle engines. Accordingly, the present invention renders active muffler systems applicable to motor vehicles in a practical way.

BRIEF DESCRIPTION OF THE DRAWINGS

The present invention will be more clearly understood by reference to the following detailed description when read in conjunction with the accompanying drawing in which like reference characters refer to like parts throughout the views and in which.

BEST MODE

Figure 1:
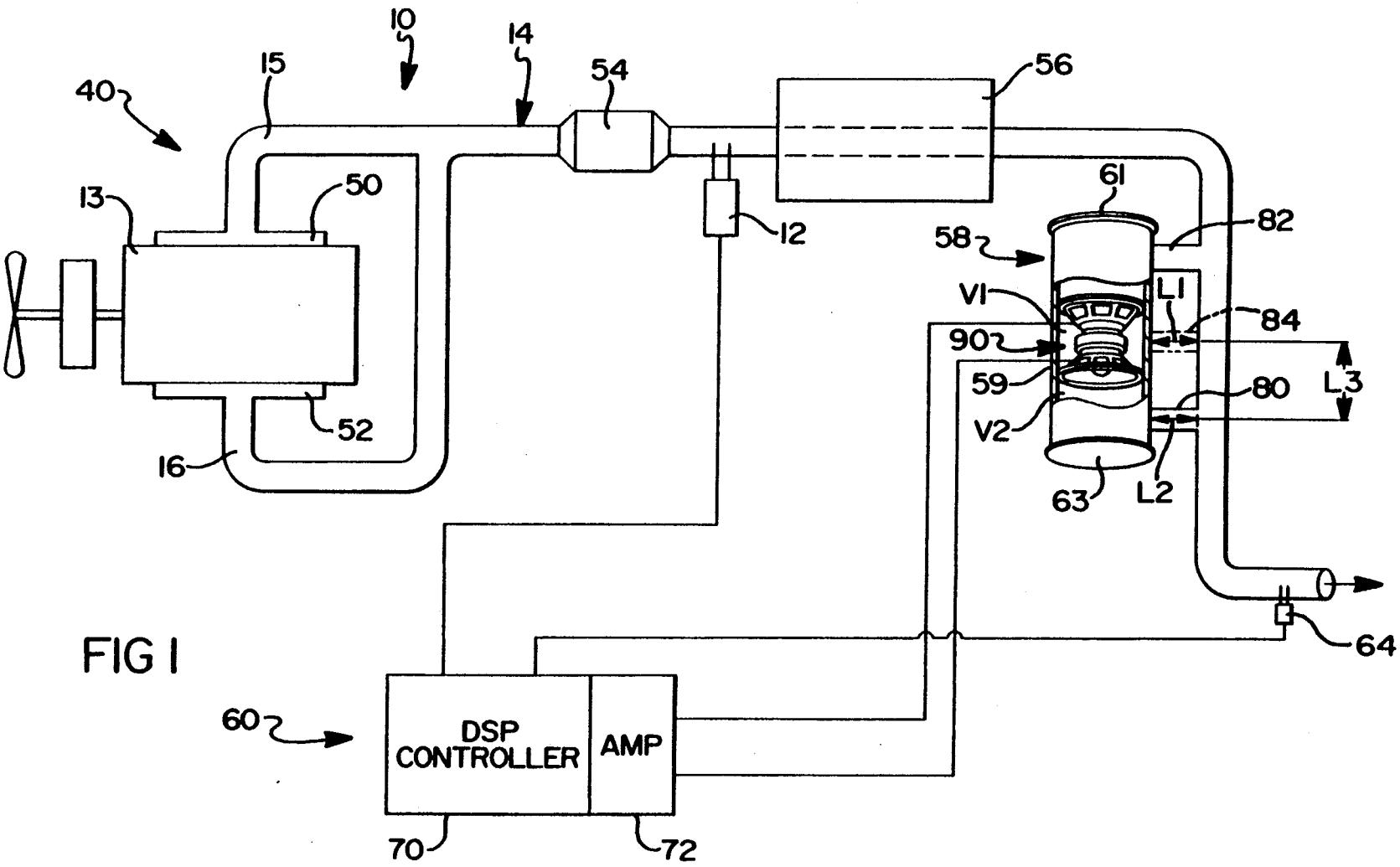
FIG. 1 is a diagrammatic view of a noise attenuation system including a transducer construction according to the present invention in an active muffler for a motor vehicle.

Referring first to FIG. 1, an active noise cancellation system 10 is diagrammatically illustrated as part of a motor vehicle exhaust system 40. The cancellation system 10 includes a microphone or transducer 12 exposed to a sound pressure pulse train delivered from a motor vehicle engine 13 through exhaust pipes 15 and 16 to a common exhaust conduit 14. The electrical signal generated by the transducer 12 in response to the sound pressure pulses is fed into electronic control 60 which in turn drives a transducer such as a loudspeaker. As is well known, the control 60 drives the transducer so that the sound pressure generated by the speaker can be introduced to the conduit 14. The emission occurs at a point at which the pulses emitted from the loudspeaker are 180° out of phase with the sound pressure pulses passing through the conduit 14 at that point.

Although there have been many improvements to active noise cancellation systems, the improvements do not relate to the transducer efficiency or space saving advantages for the conduit through which the sound pressure pulses travel. Rather, the previously known improvements to the control 60, for example, enabling it to react to changing characteristics of the sound pressure pulses due to changes at the source, or other improvements such as improved positioning or alignment of components to avoid feedback of the signal generated from the loudspeaker which is received at the transducer 12, or error compensation devices which readjust the control 60 in response to the actual degree of cancellation resulting from operation of a transducer, show that previous developments exhibit a substantially different emphasis for development of the systems. Notably, all the known prior art examples employ a single face of the transducer diaphragm to produce cancellation pulses.

The present invention makes use of the fact that a loudspeaker has a diaphragm with a front face and a rear face. As a result, each movement of the diaphragm generates a pulse in the front side which is 180° out of phase with the pulse generated at the rear side.

In accordance with the teachings of my previous applications, the faces may be enclosed in separate chambers communicating with the conduit through ports. As a result, the output from each enclosure can be tuned, since for a given port area, the resonant frequency is proportional to $(L \cdot V)^{-\frac{1}{2}}$, where L is the length of the port and V is the volume of the chamber. Preferably, two ports with two differently tuned chambers provides greater efficiency over the entire bandwidth of the cancellation signals.

When both the front and rear sides of the transducer are coupled through ported chambers as previously discussed, the outlets of the ports communicating with opposite sides of the speaker preferably communicate with the conduit at spaced apart positions along the conduit 14 separated by a distance L3. Such an arrangement provides substantially double the efficiency of a standard transducer noise cancellation set-up using output from a single side of a transducer or loudspeaker.

Moreover, the frequency band throughout which the increased efficiency occurs may be extended at the lower end (F1) and cut-off at an upper end (F2). The high cut-off frequency F2 is proportional to $(V1 \cdot L1)^{-\frac{1}{2}}$. For the purposes of motor vehicle engine exhaust, a conventional internal combustion engine exhaust valve would generate a maximum frequency of about 250 hertz.

Similarly, the lowest frequency F1 would be proportional to the $(V2 \cdot L2)^{-\frac{1}{2}}$. Typically, it will be determined as a function of a convenient idle speed for the motor vehicle engine. As a result, volumes V1 and V2 of the chambers 74 and 78, respectively, as well as the lengths L1 and L2 of the ports 84 and 82, respectively, will be determined as necessary to provide increased efficiency throughout the frequency band in which the sound pressure pulses are passed through the exhaust conduit 14.

The best performance of such a system will occur where the length L3 is substantially less than the wavelength of the highest frequency F2 to be encountered during motor vehicle operation. In addition, L2 should be substantially less than the half wavelength of the highest frequency F2.

As a result of the tuning provided by the ported chambers of the transducer mounting arrangement of the present invention, the efficiency of the transducer is substantially increased. Thus, the size of the transducer and the energy required to operate the transducer can be substantially reduced over required transducers in previously known noise cancellation systems. In particular, the reduction of energy input requirements substantially reduces the need for power amplification components which are typically the most expensive portions of the electronic control 60. Moreover, the limited space available for packaging such components in a motor vehicle does not prevent the application of an active noise attenuation system in motor vehicles as was expected from previously known noise cancellation systems.

Referring again to FIG. 1, the exhaust system 40 for a motor vehicle engine 13 includes the common exhaust conduit 14 coupled to exhaust pipes 15 and 16 communicating with the exhaust manifolds 50 and 52 respectively. The common exhaust conduit 14 refers generally to the path communicating with the exhaust pipes 15 and 16 regardless of the individual components forming the passageway through which the exhaust gases pass. For example, the catalytic converter 54 and the muffler accessory 56 form part of the conduit 14, while active noise cancellation transducer housing 58 shown for the preferred embodiment communicates with the conduit 14. The housing 58, constructed with a cylindrical wall 59 enclosed by end walls 61 and 63 in the preferred embodiment, could also be constructed to support or form part of the conduit 14. The catalytic converter 54 and the passive muffler accessory 56 may be of conventional construction for such items and need not be limited to a particular conventional construction. For example, simple noise damping insulation can be carried in a closed container, for example, to reduce vibrations in susceptible portions of the conduit 14, or to combine the passive muffler accessory 56 with an active noise cancellation system.

In addition, the exhaust system 40 includes an active noise cancellation system 10 with a controller 60 cooperating with a sensor 12 and feedback sensor 64 as well as the tandem transducer arrangement 90 carried by the transducer housing 58. The electronic control 60 includes a digital signal processing (DSP) controller 70 generating a signal responsive to the signal representative of detected noise in order to generate an out of phase cancellation signal. In addition, the controller 70 includes an amplifier circuit 72 that provides sufficient amplitude to the drive signal for the transducers in the tandem transducer arrangement 90 to match the amplitude of pressure pulses passing the locations at which the transducer arrangement 90 communicates with the conduit 14.

In the preferred embodiment, the housing 58 includes a cylindrical wall 59 which peripherally engages the support frames for the diaphragms 22 and 24 at the interface between the front and rear sides of each transducer diaphragm. Unlike the transducers that face each other in my copending application entitled "Dual Bandpass Secondary Source" where the front sides of each transducer communicate with the same chamber, the rear sides of the transducer diaphragms (nearest the magnet) in the tandem arrangement 90 are in a common chamber 74. Several developments or features concerning this arrangement are discussed in greater detail in connection with FIGS. 2–5.

Figure 2:
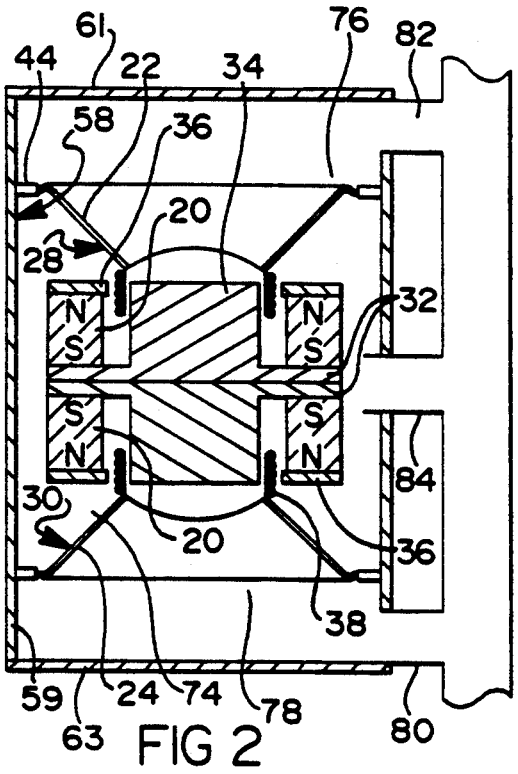
FIG. 2 is an enlarged sectional view of a transducer mounting arrangement for the circuit of FIG. 1 to construct an active muffler in a motor vehicle according to the present invention.

As shown in FIG. 2, the transducer diaphragms 22 and 24 are carried by separate transducers 28 and 30. Each transducer is structured in a conventional manner, having a ring magnet 20, a bottom plate 32 supporting a center core 34, and a top plate ring 36 radially spaced from the center core 34 to form a gap 38. A coil 40 is carried within the gap 38 by a sleeve 42 connected to the respective diaphragm 22 or 24.

The front side of transducer diaphragm 22 is separated from its rear side by a mounting seal 44 and communicates with a chamber 76. Similarly, the back side of the transducer diaphragm 24 is separated from the front side by a mounting seal 44 and communicates with the chamber 78. The mounting seal 44 in the preferred embodiment comprises the transducer frame connected by a seal to the housing wall 59. Nevertheless, it will be understood that the transducers could also be aligned in other positions producing similar results. For example, the speakers could face in the same direction but with reversed polarity coil terminals or oppositely wound coils so that the front side of one speaker facing the rear side of the other speaker moves in the opposite direction in the common chamber 74. Accordingly, either front or rear sides of a transducer could complement a side of the other speaker in common chamber 74.

As also shown in FIG. 2, the chamber 76 communicates through a port 82 with the exhaust conduit 14 while the chamber 78 communicates through a port 80 at a spaced apart position from the port 82. With such a porting arrangement, the chamber 74 may be closed so that pressure pulses emanating from the front sides of the transducers 28 and 30 will cancel each other out in the central chamber 74. In the preferred embodiment, the present invention, a port 84 couples chamber 74 in communication with the exhaust conduit 14.

It is preferable to tune the chamber 74 and port 84 for a resonant frequency at or near the highest frequency of the cancellation signal bandwidth. Since the resonant frequency is proportional to $(L \cdot V)^{\frac{1}{2}}$ for a given port area, as previously discussed, proper dimensioning of the port and chamber enables the signals emanating from the rear sides of the transducers 28 and 30 add to each other and eliminate the need for the more powerful electronics required in the amplifier 72. In addition, the ports 80 and 82 are preferably symmetrically tuned at a frequency at or near the lowest cutoff frequency in the cancellation signal bandwidth, to improve efficiency and reduce power requirements at the lowermost portion of the cancellation signal spectrum.

The equal and opposite reactions of the transducers 28 and 30 eliminate vibration that would be induced upon the housing 58 during operation of a single transducer. The equal but opposite displacement of the transducer faces avoids unopposed vibration of the housing walls forming the housing 58 and the audible noise, displacement and physical forces which would be generated as a result of transducer movements transferred to the housing in which it is mounted. However, the magnets are oppositely polarized, and may retard the flow of flux through the magnetic circuit path in the adjacent transducer.

Figure 3:
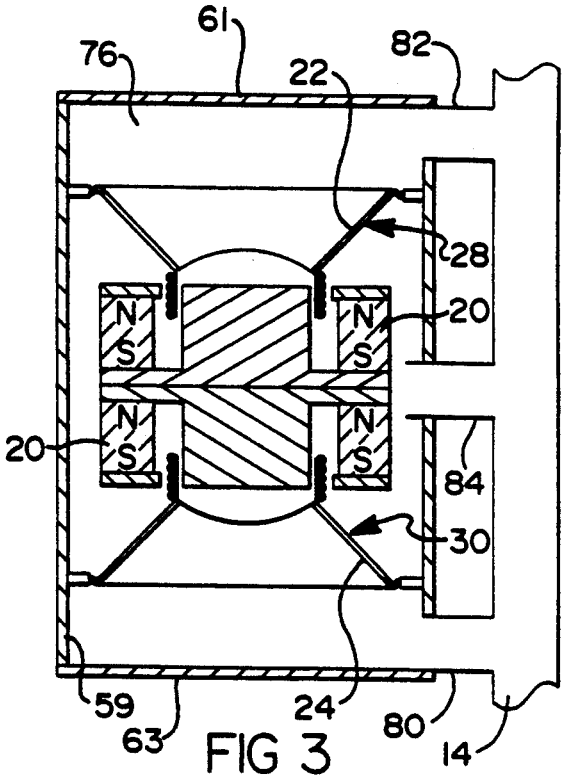
FIG. 3 is a sectional view similar to FIG. 2 of a modified transducer mounting arrangement applicable to the circuit of FIG. 1 according to the present invention.

In FIG. 3, the ring magnet 20 has been reversed so that the north and south poles are serially aligned with the poles at the adjacent ring magnet 20 and transducer 28. To maintain the in-phase displacements of the transducer diaphragms 22 and 24, the coil 40 of the transducer 30 has reversed polarity terminals compared to coil 40 of transducer 28, for example, by winding the coil in an opposite direction from the coil 40 of the transducer 28. Thus, the magnets 20 cooperate with each other to improve the magnetic field used to drive the coil and displace the diaphragm in each of the transducers.

Figure 4:
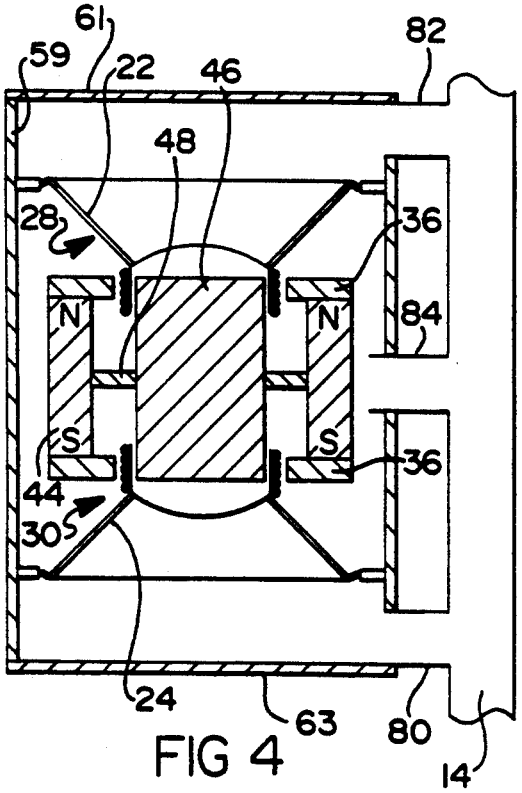
FIG. 4 is a sectional view similar to FIGS. 2 and 3 but showing modifications of the transducer mounting according to the present invention.

As shown in FIG. 4, a single ring magnet 44 rests between top plate rings 36 extending adjacent a single center pole structure 46. The center pole 46 is maintained in position by support wall 48. While this construction substantially simplifies the structure of the transducers, the device still provides two displaceable diaphragms in a manner which provides vibration compensation, and improves efficiency of the transducer diaphragm displacements by using both sides of the diaphragm and communicating through tuned ports with the exhaust conduit 14.

Figure 5:
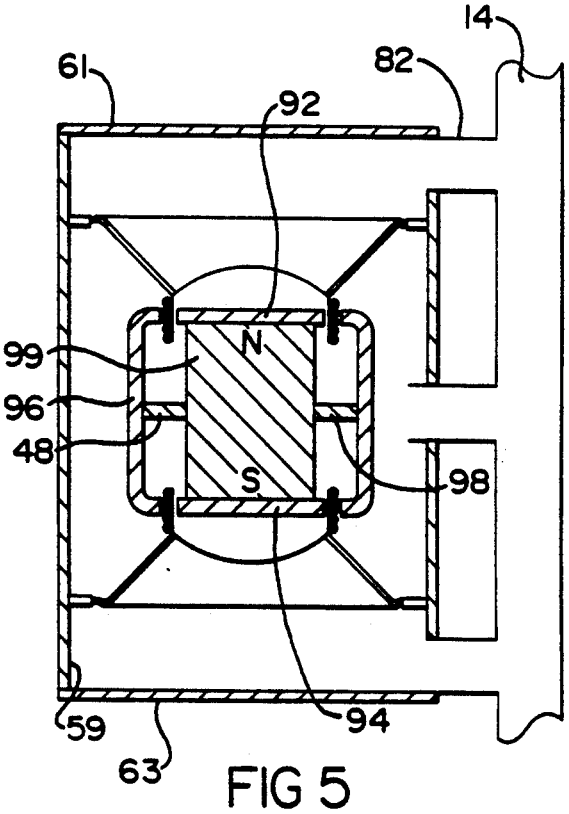
FIG. 5 is a sectional view similar to FIGS. 2–4 but showing a modified magnet for the transducer structure according to the present invention.

Referring now to FIG. 5, an alternative magnet structure is shown wherein the magnet comprises a slug magnet 99 that is substantially simpler to produce than the magnet ring 44. A magnetic flow path is completed by end plates 92 and 94 secured at opposite ends of the slug magnet 99, and wall plates 96 and 98 secured in position by a support wall 48.

As a result, the present invention provides a substantially more efficient transducer arrangement than previously known conventionally constructed transducers. The present invention provides the advantages of reduced vibration encountered when mounting a single transducer in a transducer housing. In addition, the present invention provides a substantially simpler magnet construction which is substantially easier to manufacture and is more compact within the transducer housing enclosure. In addition, the magnet construction improves the efficiency of the transducers and provides additional space within the transducer housing in which to install ports of appropriate length for tuning.

Having thus described the present invention, many modifications thereto will become apparent to those skilled in the art to which it pertains without departing from the scope and spirit of the present invention as defined in the appended claims.

I claim:

1. An active noise cancellation transducer for a motor vehicle exhaust conduit comprising:

a single magnet having north and south poles;

first and second transducer diaphragms;

means for completing a magnetic flux flow path, said means comprising at least one plate at said north pole defining a first air gap in said magnetic flux flow path, and at least one plate at said south pole defining a second air gap in said magnetic flux path;

a first coil received in said first air gap and coupled to said first diaphragm;

a second coil received in said second air gap and coupled to said second diaphragm; and wherein terminals on said first and second coils are adapted for coupling to an electrical source in reversed polarity so that in-phase drive signals generate opposite direction displacement of said first and second diaphragms; and a housing defining a common chamber communicating with one side of said first and said second diaphragms;

wherein said housing includes:

a first chamber facing said front face of said first diaphragm;

a second chamber facing said front face of said second diaphragm;

a first port for coupling said first chamber in acoustic communication with the exhaust conduit at a first position along the conduit;

a second port for coupling said second chamber in acoustic communication with the exhaust conduit at a second position along the conduit; and wherein the transducer is driven by a signal with a bandwidth, wherein the length and volume of said first port and said first chambers is defined by the relationship that the frequency is proportional to $(L \cdot V)^{-\frac{1}{2}}$ where the frequency is selected at or near the lowest frequency in said signal bandwidth; and wherein the length and volume of said second port and said second chamber is defined by the relationship that the frequency is proportional to $(L \cdot V)^{-\frac{1}{2}}$ where the frequency is selected at or near the highest frequency in said signal bandwidth.

2. The invention as defined in claim 1 wherein said first and second coils are wound in opposite directions.

3. The invention as defined in claim 1 wherein said housing includes a mounting seal for acoustically separating said front face from said rear face of each said diaphragm.

4. The invention as defined in claim 1 and further comprising a third port for coupling said common chamber in acoustic communication with the exhaust conduit.

5. The invention as defined in claim 1 wherein said magnet is a ring magnet.

6. The invention as defined in claim 1 wherein said magnet is a slug magnet.

* * * * *